US012402679B2

(12) United States Patent
Cuervo

(10) Patent No.: US 12,402,679 B2
(45) Date of Patent: Sep. 2, 2025

(54) SYSTEMS AND METHODS FOR A BRA FOR USE WITH LIMITED DEXTERITY

(71) Applicant: SpringRose, Inc., Key Biscayne, FL (US)

(72) Inventor: Nicole Sofia Cuervo, Key Biscayne, FL (US)

(73) Assignee: SpringRose, Inc., Brooklyn, NY (US)

( * ) Notice: Subject to any disclaimer, the term of this patent is extended or adjusted under 35 U.S.C. 154(b) by 0 days.

(21) Appl. No.: 18/203,918

(22) Filed: May 31, 2023

(65) Prior Publication Data

US 2023/0389624 A1 Dec. 7, 2023

Related U.S. Application Data

(60) Provisional application No. 63/347,859, filed on Jun. 1, 2022.

(51) Int. Cl.

| | |
|---|---|
| ***A41F 1/00*** | (2006.01) |
| ***A41C 3/02*** | (2006.01) |
| ***A44B 11/25*** | (2006.01) |

(52) U.S. Cl.

CPC ..... *A41F 1/006* (2013.01); *A41C 3/02* (2013.01); *A41F 1/002* (2013.01); *A44B 11/25* (2013.01)

(58) Field of Classification Search

CPC ..... A41F 1/006; A41F 1/002
USPC ..... 450/58
See application file for complete search history.

(56) References Cited

U.S. PATENT DOCUMENTS

| | | | | |
|---|---|---|---|---|
| 2,970,597 A | | 2/1961 | Milton | |
| 3,302,649 A | | 2/1967 | Bruno | |
| 3,827,441 A | * | 8/1974 | Rudolph | A41C 3/0007 450/86 |
| 4,258,440 A | * | 3/1981 | McGowan | A41D 13/1236 2/403 |
| 4,411,269 A | * | 10/1983 | Weintraub | A41C 3/02 450/85 |
| 4,879,766 A | * | 11/1989 | Hull | A41C 3/00 223/111 |
| 4,917,651 A | * | 4/1990 | Rainville | A41C 3/02 2/101 |
| 5,032,104 A | * | 7/1991 | Rainville | A41C 3/02 2/101 |
| 5,624,296 A | * | 4/1997 | Weber-Unger | A41C 3/04 2/104 |

(Continued)

OTHER PUBLICATIONS

International Search Report and Written Opinion mailed May 16, 2023 for International Patent Application No. PCT/US2023/011741, 15 pages.

*Primary Examiner* — Jocelyn Bravo
(74) *Attorney, Agent, or Firm* — Morrison & Foerster LLP

(57) ABSTRACT

A garment, such as a bra, can include a closure system that facilitates operation by a user with limited dexterity. The closure system can include a first clasp member, a second clasp member, a first finger pocket dimensioned to receive a first finger, and a second finger pocket dimensioned to receive a second finger. In use, the wearer can insert first and second fingers into the respective finger pockets and pinch or otherwise move their fingers toward each other to move the first and second clasp members together. The first and second clasp members can be selectively coupled or decoupled to secure or remove the garment from the wearer.

17 Claims, 11 Drawing Sheets

(56) References Cited

U.S. PATENT DOCUMENTS

| | | | | |
|---|---|---|---|---|
| 6,253,424 | B1 * | 7/2001 | Rainville-Lonn | A41C 3/02 24/697.2 |
| 7,931,521 | B1 * | 4/2011 | Griffin | A41F 15/002 450/86 |
| 9,144,338 | B1 * | 9/2015 | Skinner | A44B 11/20 |
| 9,814,341 | B2 * | 11/2017 | Kobyluck | A47G 25/90 |
| 11,910,845 | B2 | 2/2024 | Cuervo | |
| 11,937,650 | B2 | 3/2024 | Moylan | |
| 2001/0053655 | A1 | 12/2001 | Keith | |
| 2003/0005558 | A1 * | 1/2003 | Wong | A41F 1/006 24/303 |
| 2003/0019084 | A1 * | 1/2003 | Wong | A41F 1/006 24/303 |
| 2004/0259468 | A1 * | 12/2004 | Bergamelli | A44B 11/258 450/58 |
| 2005/0102802 | A1 * | 5/2005 | Sitbon | A45C 13/1069 24/303 |
| 2006/0079153 | A1 * | 4/2006 | Davidson | A41C 3/02 450/58 |
| 2009/0075562 | A1 * | 3/2009 | Lung | A41C 3/12 450/86 |
| 2010/0178847 | A1 | 7/2010 | Buriak | |
| 2012/0117764 | A1 * | 5/2012 | Wong | A44B 11/258 24/302 |
| 2018/0146730 | A1 * | 5/2018 | Fildan | A41F 1/006 |
| 2019/0082760 | A1 * | 3/2019 | Weispfennig | A41F 15/002 |
| 2020/0138122 | A1 | 5/2020 | Stein | |
| 2020/0345080 | A1 | 11/2020 | Edmark | |
| 2022/0183400 | A1 | 6/2022 | Moylan | |
| 2023/0049200 | A1 * | 2/2023 | Muhlenfeld | A41C 3/0057 |

* cited by examiner

SYSTEMS AND METHODS FOR A BRA FOR USE WITH LIMITED DEXTERITY

CROSS REFERENCE TO RELATED APPLICATIONS

This application claims the benefit of and priority to U.S. Provisional Patent Application No. 63/347,859, filed on Jun. 1, 2022, and entitled "SYSTEMS AND METHODS FOR A BRA FOR USE WITH LIMITED DEXTERITY," the entirety of which is incorporated herein by reference.

REFERENCE REGARDING FEDERALLY SPONSORED RESEARCH OR DEVELOPMENT

Not applicable.

SEQUENCE LISTING

Not applicable.

BACKGROUND

1. Field of the Invention

The present disclosure relates generally to an article of clothing. More particularly, the present disclosure relates to brassieres ("bras") and other undergarments and the functionality and accessibility of a closure and adjustment system thereof.

2. Description of the Background

A variety of conditions, events, or abnormalities can limit the mobility and/or dexterity of a person. In particular, certain upper body mobility impairments can include, for example, limited dexterity, limited shoulder mobility, and restricted or non-existent use of one or both arms. Limited mobility or dexterity can be caused by a variety of factors, including injury, surgery, aging, birth abnormalities, or onset of disease. As such, a variety of mobility or dexterity impairments may decrease a person's ability to easily, independently, painlessly, or successfully put on, adjust, and secure certain articles of clothing, including conventional bras. For example, conventional bras having a rear closure can require a certain level of finger dexterity to secure the closure and adjust the bra straps. Additionally, conventional bras can require cumbersome movement and rotation of shoulders to extend arms through shoulder straps of the bra. Other conventional bras can include a front closure that can similarly require certain finger dexterity and closure manipulation that can include twisting, pivoting, snapping, and/or precise clasp alignment for example, that may be difficult to secure single-handedly and/or with limited mobility or dexterity.

SUMMARY

An article of clothing, and in particular, a bra, as described herein, may have various configurations. The bra may have a closure system that includes first and second clasp members that can be coupled to one another to secure the bra. The closure system can also include one or more finger engaging members that can facilitate manipulating front panels of the bra and coupling the first and second clasp members. In some embodiments, the finger engaging members can be configured as pockets or openings that a user can insert a finger into to urge each of the clasp members medially to secure the bra on a wearer (e.g., the user themself).

In some embodiments, the present disclosure provides a bra for securing or supporting breasts of a user with limited dexterity. The bra can include a shoulder strap adjustment system that includes first and second sliders through which each respective shoulder strap can extend through. Each shoulder strap can include a distal end that can be threaded through the respective slider and doubled back on a strap body of the respective shoulder strap. The distal end can include a first fastener half and the strap body can include a second fastener half so that the distal end can be pulled (or retracted) through the slider to shorten (or lengthen) the shoulder straps and then secured to the strap body of the shoulder strap via the fasteners. The first and second fastener halves can include a hook and loop fastener (e.g., Velcro).

In some embodiments, the present disclosure provides an undergarment configured to facilitate operation by a wearer with limited dexterity. The undergarment can include a front portion having a first panel and a second panel. The first panel can be configured to at least partially surround a first breast and the second panel can be configured to at least partially surround a second breast. The undergarment can also include a rear portion, first and second lateral side portions, a band, and a closure system. The first lateral side portion can connect the first panel of the front portion with the rear portion. The second lateral side portion can connect the second panel of the front portion with the rear portion. The band can be configured to extend circumferentially around a rib cage of the wearer. The band can be disposed along a bottom of each of the first and second panels at the front portion. The closure system can be configured to connect the band to form a closed loop. The closure system can include a first clasp member, a second clasp member, a first finger engaging member, and a second finger engaging member. The first finger engaging member can be adjacent to the first clasp member and can include an opening dimensioned to receive a first finger. The second finger engaging member can be adjacent to the second clasp member and can include an opening dimensioned to receive a second finger.

In some embodiments, the present disclosure provides a closure system for an article of clothing. The closure system can include first and second clasp members and first and second finger pockets. The second clasp member can be configured to be selectively coupled and decoupled from the first clasp member. The first and second finger pockets can each include openings and can be dimensioned to receive first and second fingers, respectively. The opening in the first finger pocket can be positioned laterally away from the first clasp member and the second finger opening can be positioned laterally away from the second clasp member so that the first and second fingers can engage the respective first and second finger pockets and move in a medial direction to move the first and second clasps toward each other to couple or decouple the closure system.

In some embodiments, the present disclosure can provide a method of securing a bra. The method can include positioning a first shoulder strap of the bra over a first shoulder of a wearer, positioning a second shoulder strap of the bra over a second shoulder of the wearer, inserting a first finger into a first finger pocket disposed on a medial portion of a first panel of the bra, the first panel configured to at least partially surround a first breast, and inserting a second finger into a second finger pocket disposed on a medial portion of a second panel of the bra, the second panel configured to at least partially surround a second breast. The method can further include moving each of the first and second fingers in a medial direction (with respect to a torso of the wearer) within the respective finger pockets to engage first and second clasp members of the bra that are disposed on the medial portions of the respective first and second panels of the bra.

DETAILED DESCRIPTION OF THE DRAWINGS

Figure 1:
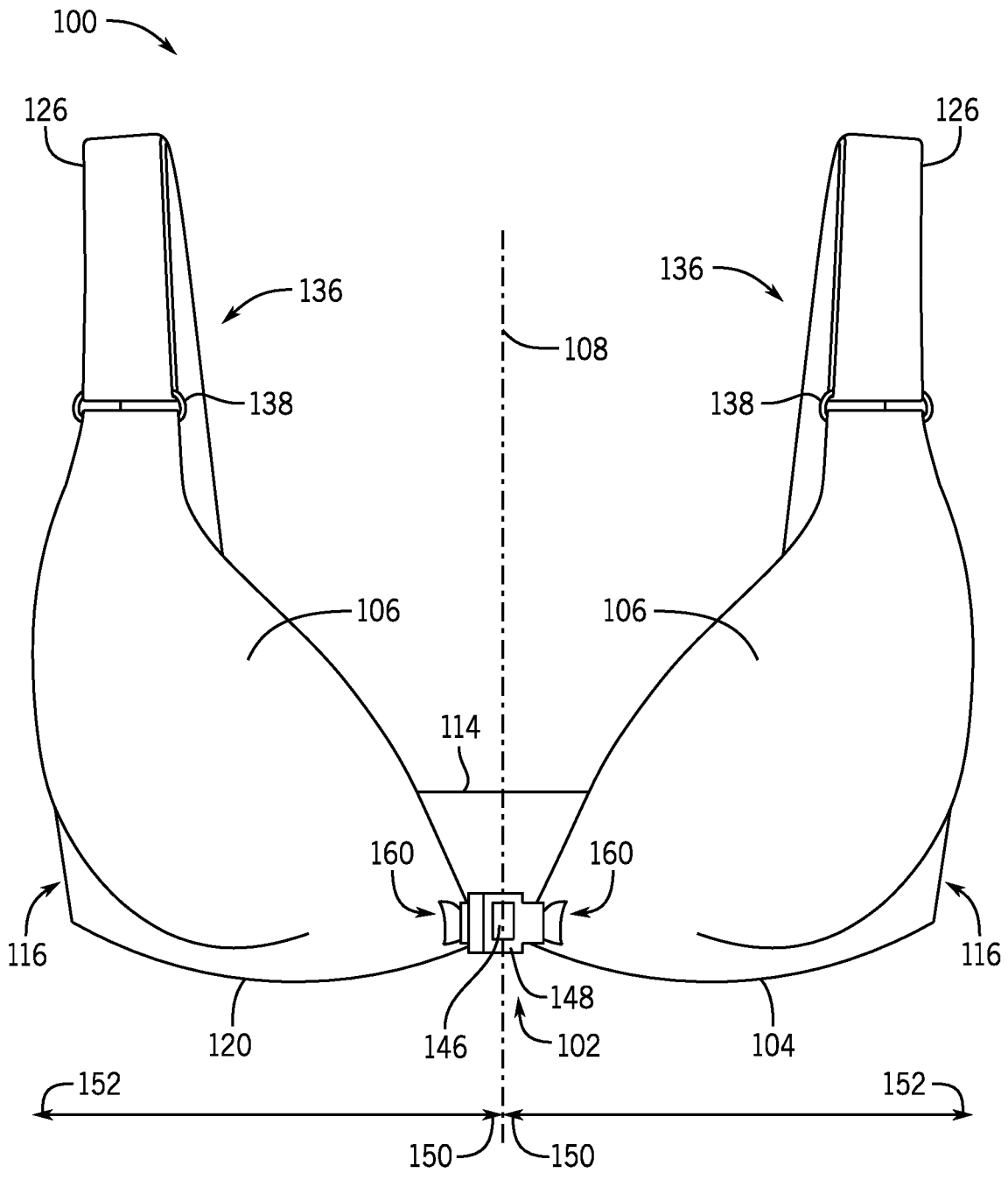
FIG. 1 is a front view of a bra that facilitates operation by someone with reduced dexterity according to an embodiment of the present disclosure.

The following discussion and accompanying figures disclose various embodiments or configurations of a bra and a closure system. Although embodiments of a bra or closure system are disclosed with reference to a wireless bra, concepts associated with embodiments of the bra or closure system may be applied to a wide range of undergarments and closure systems, including underwire bras, bralettes, strapless bras, nursing bras, and racerback bras, for example. Concepts of the bra or closure system may also be applied to other articles of clothing including underwear, swimwear, lingerie, and other corrective or supportive garments that may benefit from an adjustable or limited mobility closure system. Accordingly, concepts described herein may be utilized in a variety of consumer products.

The term "about," as used herein, refers to variation in the numerical quantity that may occur, for example, through typical measuring and manufacturing procedures used for articles of clothing or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

As briefly described above, a variety of conditions, events, or abnormalities can limit the mobility and/or dexterity of a person. In particular, certain upper body mobility impairments can include, for example, limited dexterity or other limited mobility in digits or extremities. Limited mobility or dexterity can be caused by a variety of factors, including stroke paralysis, nerve damage, injuries, surgery, amputation, aging, birth abnormalities, arthritis, fibromyalgia, scleroderma, and other diseases. As such, a variety of dexterity impairments may decrease a person's ability to easily, independently, painlessly, or successfully put on, adjust, and secure certain articles of clothing, including bras.

For example, conventional bras having a rear closure can require a certain level of finger dexterity to secure the closure and adjust the bra straps. Additionally, conventional bras can require cumbersome movement and rotation of shoulders to extend arms through shoulder straps of the bra. Other conventional bras can include a front closure that can similarly require certain finger dexterity and closure manipulation that can include twisting, pivoting, snapping, and/or precise clasp alignment for example, that may be difficult to secure with limited mobility or dexterity. Furthermore, conventional front-closure bras can require significant grip strength to bring the two bra panels medially together in front of or beneath the breasts, which also often uses multiple fingers of each hand (e.g., both left and right thumb and index fingers) to hold the bra panels together as the user aligns the closure.

Thus, embodiments of the present disclosure address these and other drawbacks of conventional bras. For example, embodiments of the present disclosure provide a bra having a closure system configured to facilitate use by someone with reduced or limited dexterity. In particular, embodiments of the closure system described herein can provide a front closure that is accessible while wearing the bra. The closure system can provide a simplified closure mechanism that can be secured via limited digit involvement (e.g., two-finger operation such as two index fingers) or secured using a single hand (e.g., two-finger operation such as index finger and thumb of a single hand). In contrast, conventional front closures may include one or more closure systems that require a moderate degree of dexterity (e.g., more than one hand or more than two fingers, such as index finger and thumb coordination of two hands) and the application of a securing force. Such conventional front closures can include one or more of hook and eye clasps, slidable pin and groove clasps that require a certain rotation to engage and disengage the clasp ends, and snap closures that require significant force to connect and disconnect the mating halves.

Further, embodiments of the disclosure can provide a bra having adjustable straps (i.e., in a vertical direction) that can be infinitely (e.g., continuously) adjusted to tighten or loosen the shoulder straps of the bra. Conventional bra straps may be adjusted via a two-handed operation that requires pulling a portion of the strap through a metal or plastic slider. Adjustment of conventional bra straps can be time consuming and difficult to access given the slider component often is positioned at a posterior location when the user is wearing the bra. While some users may attempt to reach the difficult position of the sliders, others may attempt a trial-and-error method and make adjustments before putting on the bra, often only to find further adjustments are required.

FIG. 1 illustrates an exemplary embodiment of a bra 100 having a closure system 102 configured to be positioned at an anterior (i.e., front of the body) position of the user. The bra 100 can include a front portion 104 having first and second panels 106 that can each be generally triangularly shaped or otherwise define cup portions of the bra 100. Typically the first panel 106 is symmetric with the second panel 106 about a central vertical axis 108, however, other geometries are possible. In general, the cup portions of the bra can be used to surround and/or support breasts of the user. While the first and second panels 106 generally define similar geometries to that of traditional bras, other geometries and constructions are possible, including geometries that may provide more or less coverage or support to the user.

The bra 100 can further include a rear portion 114 opposite the front portion 104. The rear portion 114 can be connected to the front portion 104 via first and second lateral side portions 116. Each of the first and second lateral side portions 116 can at least partially define a band 120 of the bra 100. The band 120, similar to conventional bras, can be disposed along a bottom of each of the first and second panels 106. In general, the band 120 is configured to surround (e.g., extend circumferentially around) the rib cage of the wearer below the breasts and can define at least one dimension (e.g., band size) used by a wearer to determine the fit of the bra 100. In a secured configuration of the bra 100, the band 120 forms a continuous circuit or closed loop around the torso of the user and extends generally horizontally below their breasts. However, it should be appreciated that different torso geometries can affect the exact orientation or contours of the band 120. Additionally, in some embodiments, the band 120 or portions of the band 120 can include an elastic material to further provide adjustment and comfort of the bra 100.

The bra 100 can further include first and second shoulder straps 126. Each of the first and second shoulder straps 126 also connect the front portion 104 and the rear portion 114. In particular, each of the first and second shoulder straps 126 can extend from a top portion of the respective first and second panels 106. In some embodiments, the first and second panels 106 can be integrally formed with or otherwise affixed to the rear portion 114. Additionally or alternatively, the first and second shoulder straps 126 can be integrally formed or otherwise fastened to the respective first and second panels 106.

In some embodiments, the shoulder straps 126 may be adjustable via an adjustment system 136. The adjustment system 136 can be configured to adjust the shoulder straps 126 independently of one another in a vertical direction to lengthen or shorten the shoulder straps 126 of the bra 100. In the illustrated embodiment, the adjustment system 136 can include first and second sliders 138 at the respective first and second shoulder straps 126. The sliders 138 may act as a link between the first and second panels 106 and the respective first and second shoulder straps 126.

In use, the first shoulder strap 126 may be threaded through the first slider 138 and folded back on itself so that the first shoulder strap 126 forms a loop adjacent to the top portion of the first panel 106 and a distal end of a strap body of the shoulder strap 126 extends toward the rear portion 114 of the bra 100. In some embodiments, the distal end of the shoulder strap 126 may terminate proximate to the top of the wearer's shoulder. The user can then separate (e.g., pull away) the distal end of the shoulder strap 126 from a proximal portion of the shoulder strap 126 and pull or retract the shoulder strap 126 through the first slider 138 to tighten or loosen the shoulder strap 126. In some embodiments, the distal end of the shoulder strap 126 may be selectively secured to a proximal portion of the shoulder strap 126 via a hook and loop fastener (e.g., Velcro®). The second shoulder strap 126 may be similarly adjusted in length via the second slider 138.

With continued reference to FIG. 1, the closure system 102 can include a first clasp member 146 and a second clasp member 148. The first clasp member 146 can be secured to the first panel 106 at a medial portion near the band 120 and the second clasp member 148 can be secured to the second panel 106 at a medial portion near the band 120. In particular, the first clasp member 146 can extend in a medial direction 150 (i.e., toward a center of the user, bra 100, and axis 108) from the first panel 106 and the second clasp member 148 can extend in the medial direction 150 from the other panel 106. In use, the first clasp member 146 can be inserted into the second clasp member 148 (or vice versa) to secure the bra 100 and form a continuous circuit at the band 120. Advantageously, the closure system 102 can be secured without requiring any twisting, turning, or pivoting of the medial sections (i.e., adjacent to the axis 108) of the first and second panels 106. Furthermore, the closure system 102 can be secured using a single hand. For example, a single hand can pinch finger engaging members 160, which can be configured as pockets or other members, to couple (or decouple) the clasp members 146, 148.

In general, fastening the closure system 102 of the bra 100 promotes quick and simple bra securement, especially for users with reduced dexterity, such as limited or non-existent finger, wrist, or arm movement, for example. Similarly, releasing the closure system 102 of the bra 100 can be accomplished by a user with reduced dexterity. In the illustrated embodiment, a portion of the first clasp member 146 may be pressed inward (e.g., in a posterior direction) or otherwise disengaged from the second clasp member 148 without requiring the user to bend, twist, or rotate any part of the closure system 102 or first and second panels 106. For example, a force exerted in a single direction (e.g., posterior) can be used to release the closure system 102 and then little or no force may be required to separate the first and second clasp members 146, 148 in a second direction that is generally perpendicular to the first direction. The second direction can be a lateral direction 152. When the closure system 102 is in a released orientation, the bra 100 can be removed from (or put on) the user in a similar motion to removing (or putting on) a vest.

In some embodiments, the closure system 102 can include a magnet. The magnet can be used to facilitate a preliminary alignment of the first and second clasp member 146, 148 or can be incorporated into the first and second clasp members 146, 148 so that the closure system 102 remains in a closed position via a magnetic force. In general, the magnet within the closure system 102 can advantageously help align the medial sections of the first and second panels 106, especially one-handedly, so that a user can effectively and efficiently secure the bra 100. In some embodiments, the magnet strength of the magnet within the closure system 102 can be tailored to an individual's preference or need. By way of example, a user with limited dexterity and only a single hand or arm may benefit from a different-strength magnetic closure system 102 than another user with carpal tunnel syndrome.

Figure 2:
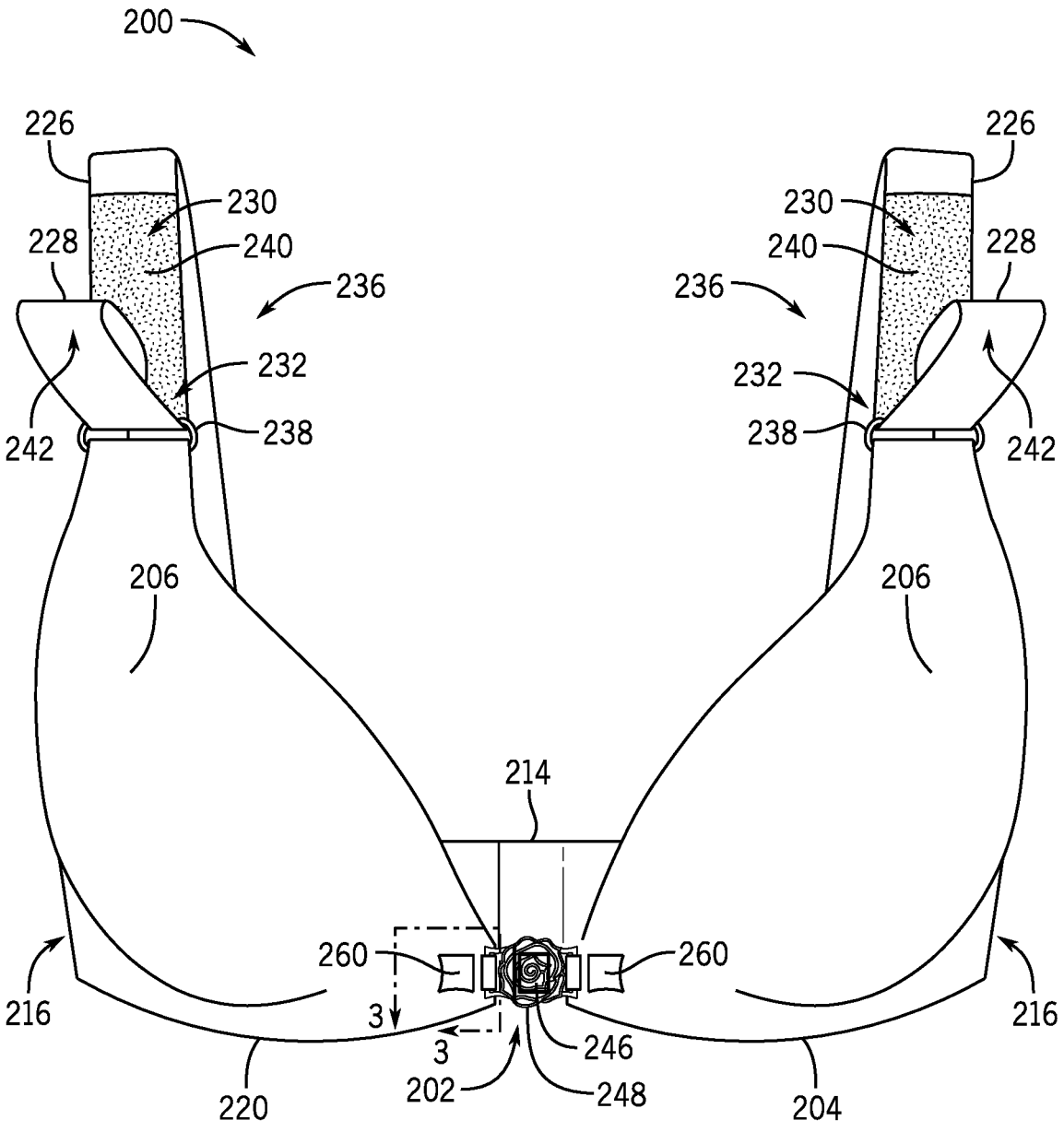
FIG. 2 is a front view of a bra that facilitates operation by someone with reduced dexterity according to another embodiment of the present disclosure.

FIG. 2 illustrates another embodiment of a bra 200 having a closure system 202. Like the bra 100, the closure system 202 of the bra 200 is configured to be positioned at an anterior position of the user when the user is wearing the bra 200. The bra 200 includes a front portion 204 having first and second panels 206 that can be generally triangularly shaped and can define cup portions of the bra 200. The bra 200 can further include a rear portion 214 opposite the front portion 204. The rear portion 214 can be connected to the front portion 204 via first and second lateral side portions 216. The first and second lateral side portions 216 can at least partially define a band 220 of the bra 200.

The bra 200 can further include first and second shoulder straps 226 that connect the front portion 204 and the rear portion 214. The shoulder straps 226 can each define respective distal ends 228 and a strap body 230. In the illustrated embodiment, the strap body 230 of the shoulder straps 226 can extend between the distal end 228 and the rear portion 214 of the bra 200. Additionally, the shoulder straps 226 can include a fold or a loop 232 in the strap body 230 adjacent to the top portion of the respective first and second panels 206.

In some embodiments, the shoulder straps 226 may be adjustable via an adjustment system 236. The adjustment system 236 can be configured to adjust the shoulder straps 226 independently of one another in a vertical direction to lengthen or shorten the shoulder straps 226 of the bra 200. In the illustrated embodiment, the adjustment system 236 can include first and second sliders 238 at the loop 232 of the shoulder straps 226. The sliders 238 may act as a link between the first and second panels 206 and the respective first and second shoulder straps 226.

In use, one of the shoulder straps 226 may be threaded through the slider 238 and folded back on itself so that the distal end 228 extends toward the rear portion 214 of the bra 200. In some embodiments, the distal end 228 of the shoulder strap 226 may terminate proximate to the top of the wearer's shoulder, or otherwise at an anterior position of the wearer so that the user can access the distal end 228 without reaching behind their shoulder. To lengthen or shorten the shoulder straps 226, the user can grab the distal end 228 of the shoulder strap 226 and separate (e.g., pull away) the distal end 228 from the strap body 230. The user can then pull or retract the shoulder strap 226 through the slider 238 to tighten or loosen the strap 226.

In some embodiments, one side of the strap body 230 of the shoulder strap 226 can include a first fastener portion and one side of the distal end 228 of the shoulder strap 226 can include a second fastener portion configured to engage and be secured with the first fastener portion. For example, one side 240 of the strap body 230 can include one of a hook and loop material of a hook and loop fastener (e.g., Velcro), and one side of the distal end 228 can include the other of the hook and loop material of the hook and loop fastener. In other embodiments, the adjustment system 236 can include a magnetic fastener. Thus, in use, the user can selectively couple the distal end 228 to the strap body 230 of the respective shoulder strap 226 to set their preferred strap length, particularly while wearing the bra 200.

In the illustrated embodiment, the distal end 228 further includes a grip portion 242. The grip portion 242 can be configured as a loop, pocket, opening, or protrusion in the distal end 228 to facilitate gripping or manipulating the distal end 228 to separate the distal end 228 from the strap body 230 to adjust the lengths of the shoulder straps 226. An opening provided by the grip portion 242 can help a user with limited dexterity to separate the distal end 228 from the strap body 230. For example, a user with limited finger dexterity may have trouble closing their fingers together such that grasping items is difficult. The grip portion 242 can allow the user to slide one or more fingers through the distal end 228 and allow them to pull the distal end 228 away from the strap body 230 without requiring a grasping (e.g., closing one's fingers) motion.

With continued reference to FIG. 2, the closure system 202 can include a first clasp member 246 and a second clasp member 248. The first clasp member 246 can be secured to the first panel 206 at a medial portion near or in line with the band 220 and the second clasp member 248 can be secured to the second panel 206 at a medial portion near or in line with the band 220. In use, the first clasp member 246 can be inserted into, or otherwise secured relative to, the second clasp member 248 to secure the bra 200 and form a continuous loop at the band 220. Advantageously, the closure system 202 can be secured generally without requiring twisting, turning, or pivoting of the first and second clasp members 246, 248 nor the first and second panels 206.

The closure system 202 can further include finger engaging members 260 configured as finger pockets having one or more finger openings. The finger engaging members 260 can be disposed on the medial portions of the panels 206 adjacent to respective first and second clasp members 246, 248. In particular, the finger engaging members 260 can be formed along or defined by the band 220. In use, a user can insert one finger into each finger engaging member 260 to manipulate the medial portions of the panels 206 and move the first clasp member 246 toward the second clasp member 248. For example, the user can insert a first finger (e.g., a right index or middle finger) into a first finger engaging member 260 and a second finger (e.g., a left index or middle finger) into a second finger engaging member 260 and urge each of the panels 206 medially (with respect to their body) so that the first clasp member 246 is urged toward and eventually engaged with and secured to the second clasp member 248. In another example, a user can use a single hand to engage each of the finger engaging members 260 (e.g., an index finger and a thumb of the same hand). However, it should be appreciated that other combinations of digits or appendages can be used to operate the closure system 202.

Furthermore, similar to the closure system 102, the closure system 202 can include one or more magnets. The magnets can be used to facilitate a preliminary alignment or engagement of the clasp members 246, 248. For example, the magnets can help attract and align the clasp members 246, 248 before the clasp members are in a locking engagement. Once the clasp members 246, 248 are aligned, they can be moved into a sliding engagement with each other to close and secure the bra 200. In the illustrated embodiment, the clasp members 246, 248 are disposed medially inward from the finger engaging members 260. That is, the finger engaging members 260 are positioned laterally outward from the clasp members 246, 248 so that when the closure system 202 is in a closed position, as shown in FIG. 2, the finger engaging members 260 and the clasp members 246, 248 extend in a transverse direction across the front of the bra 200 and are not stacked on top of each other. Thus, in a closed position, the finger engaging members 260 and the clasp members 246, 248 may be positioned along a circuit generally defined by the bra 200 band 220.

Figure 3:
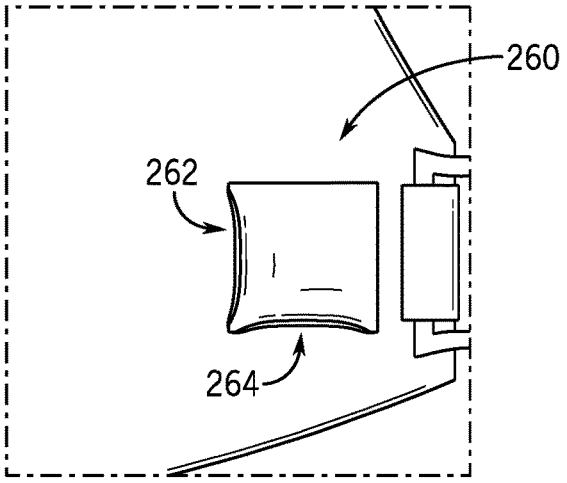
FIG. 3 is a detailed view of the section 3-3 of FIG. 2 showing a finger opening.

With reference to FIG. 3, the finger engaging member 260 can provide one or more openings. Though only one of the two finger engaging members 260 of the bra 200 is shown, it should be appreciated that the other finger engaging member 260 can have similar (e.g., symmetric) openings. In the illustrated embodiment, the finger engaging member 260 provides a first opening 262 and a second opening 264. The arrows in FIG. 3 indicate the direction in which a finger may be inserted into the finger engaging member 260 to move the first and second clasp members 246, 248 toward each other.

For example, a finger may be inserted into the first opening 262 and the closing motion for closing the bra 200 may include pointing the first finger from a right hand toward a second finger from a left hand (similarly inserted into the other finger engaging member 260) and moving the right and left hands medially under (or across, or near) the breasts of the user. Alternatively, a finger may be inserted into the second opening 264 and the closing motion for closing the bra 200 may include pointing the first finger from a right hand upward and pointing a second from a left hand (similarly inserted into the other finger engaging member 260) upward and moving the right and left hands medially so that the first and second fingers are generally parallel. In other examples, a single hand can be used so that two fingers of one hand can engage either of the openings 262, 264 on each panel 206 and move in a pinching motion to close the bra 200.

In general, each finger engaging member 260 promotes single finger operation and does not require the user to grasp a single element of the closure system 202 between two fingers of one hand, which is often required on closure systems (front or rear) of conventional bras. Additionally, while only two openings 262, 264 are shown in the illustrated embodiment, additional (or fewer) openings are possible (see, for example, FIG. 9). Furthermore, as shown in FIG. 3, the finger engaging member 260 can be configured as a piece of material secured at the band 220 of the bra 200. However, in other embodiments, the finger engaging member 260 can be more integral with the band. For example, the band 220 may be generally sewn as a tube, and a medial end of the tube may be opened and folded laterally (e.g., away from a central axis, opposite the medial direction) and sewn or otherwise affixed on the sides to form a pocket.

Figure 4:
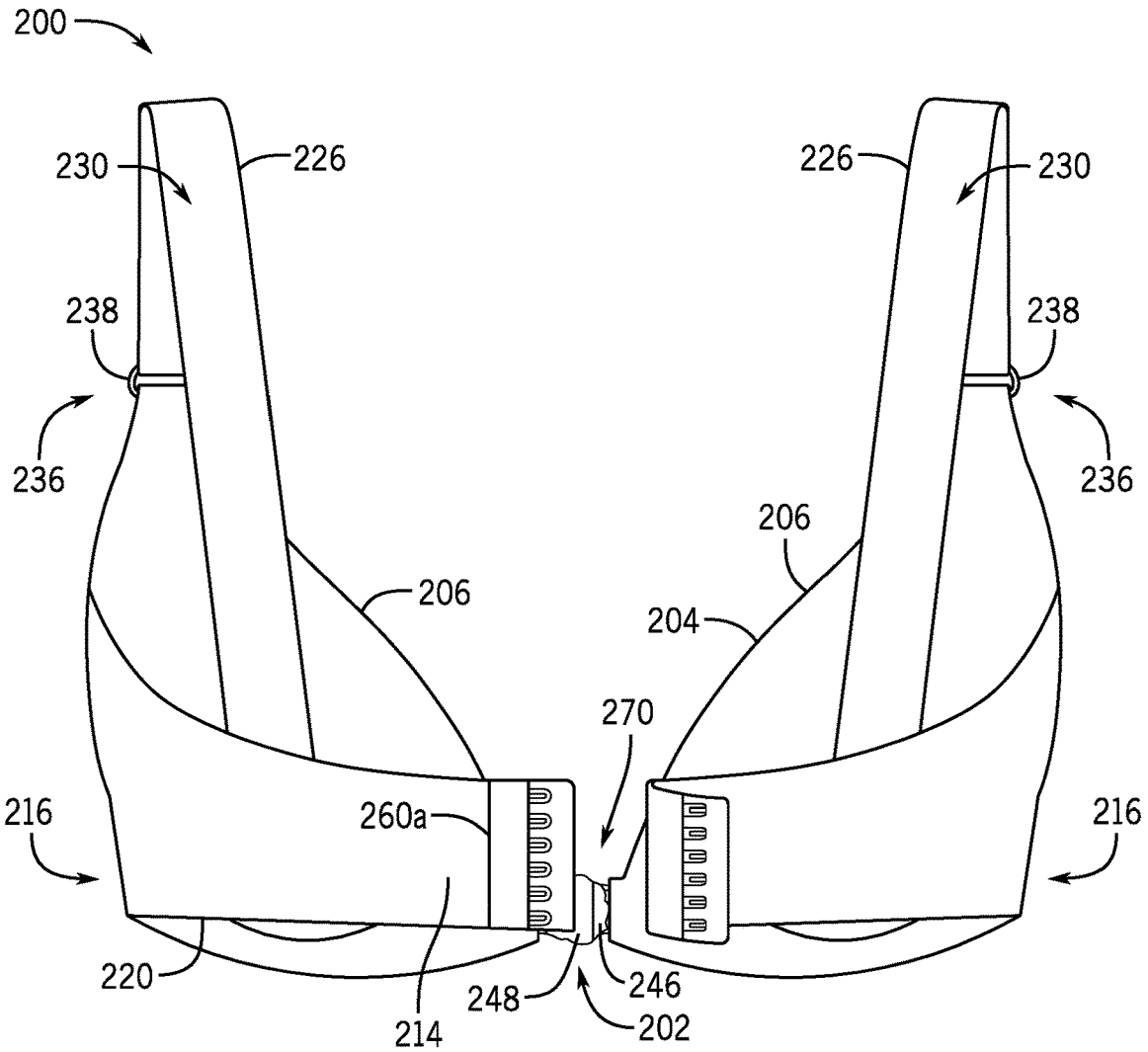
FIG. 4 is a rear view of the bra of FIG. 2.

FIG. 4 illustrates a rear review of the bra 200. In some embodiments, the rear portion 214 can optionally include a rear closure system 270. In some embodiments, the rear closure system 270 may be in addition to or in lieu of the front closure system 202. Alternatively, the front closure system 202 may be the only closure system of the bra 200 and the rear portion 214 is permanently fixed (or integrally formed) so that the bra 200 is not separatable at the rear portion 214. Further, in some embodiments, the rear closure system 270 can also include one or more finger engaging members 260*a* (though only one finger engaging member 260*a* is visible in FIG. 4). Similar to the finger engaging member 260, the rear finger engaging members 260*a* can be a pocket sewn or otherwise formed on the band 220 that can be engaged by a digit to facilitate a closing operation on either side of the rear closure system 270.

FIGS. 5A-D illustrate the first and second clasp members 246, 248 of the closure system 202 according to an exemplary embodiment. As shown, the first and second clasp members 246, 248 can form a flower design that is separable when the closure system 202 is in an open or disengaged orientation; however, alternative designs are contemplated. In general, fastening the closure system 202 of the bra 200 facilitates quick and easy bra securement, especially for users with reduced dexterity, such as limited finger, wrist, or arm movement. Similarly, releasing the closure system 202 of the bra 200 can be accomplished by a user with reduced dexterity.

Figure 5A:
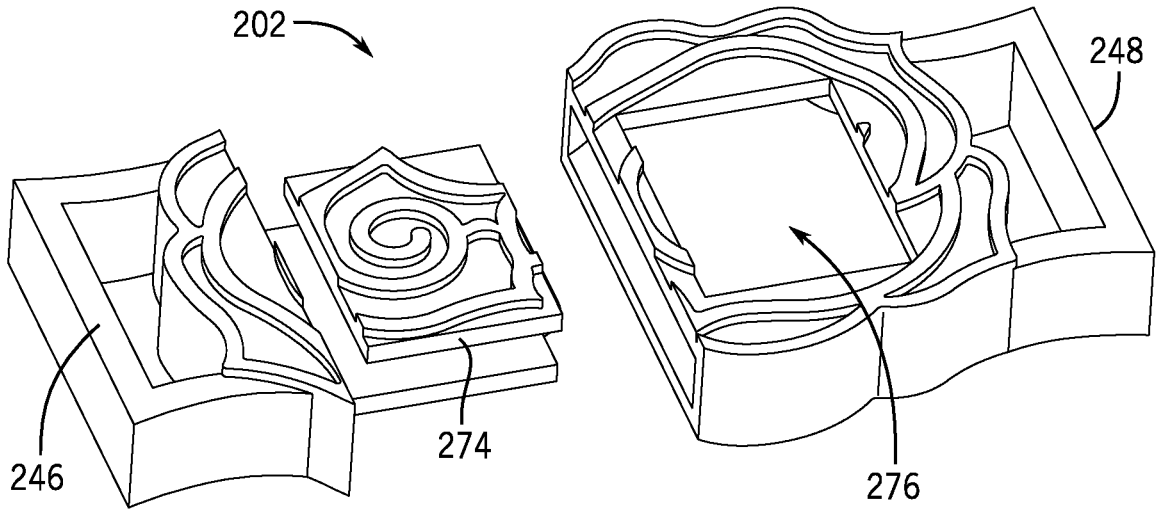
FIG. 5A is a front isometric view of a clasp assembly of the bra of FIG. 2 in an open configuration.
Figure 5B:
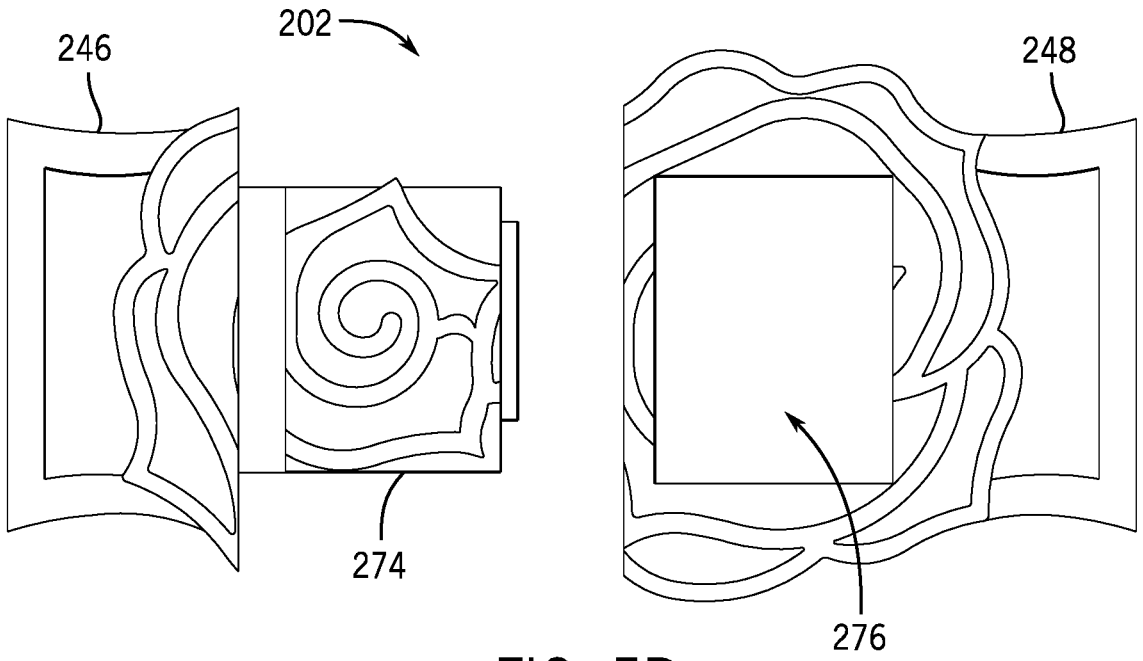
FIG. 5B is a front view of the clasp assembly of FIG. 5A in an open configuration.
Figure 5C:
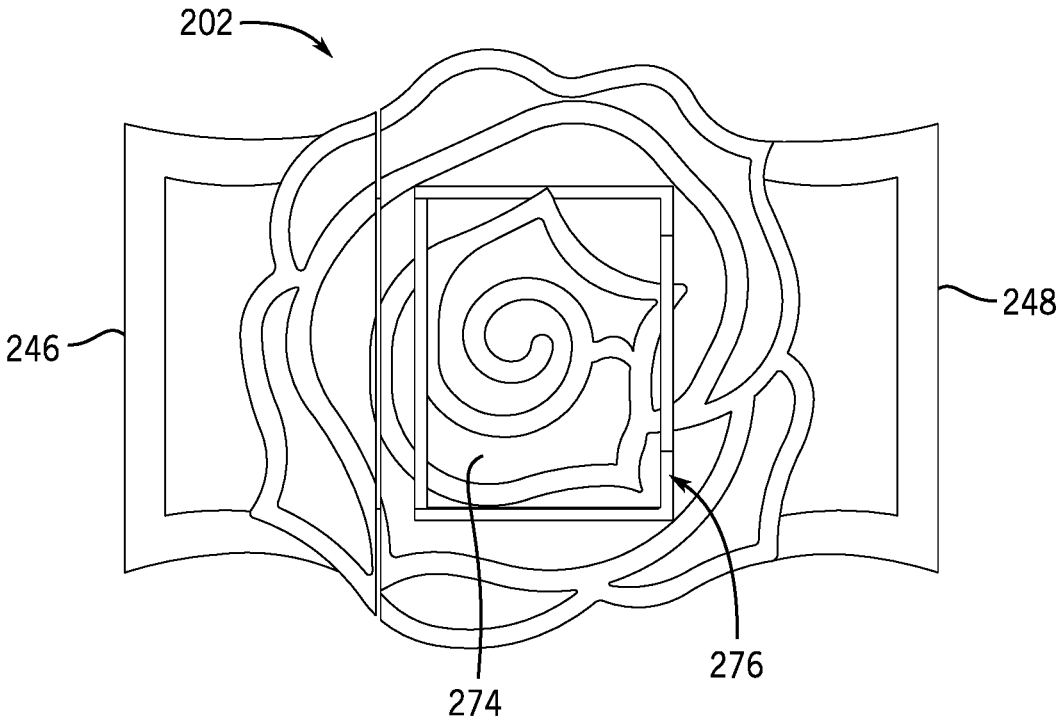
FIG. 5C is a front view of the clasp assembly of FIG. 5A in a closed configuration.
Figure 5D:
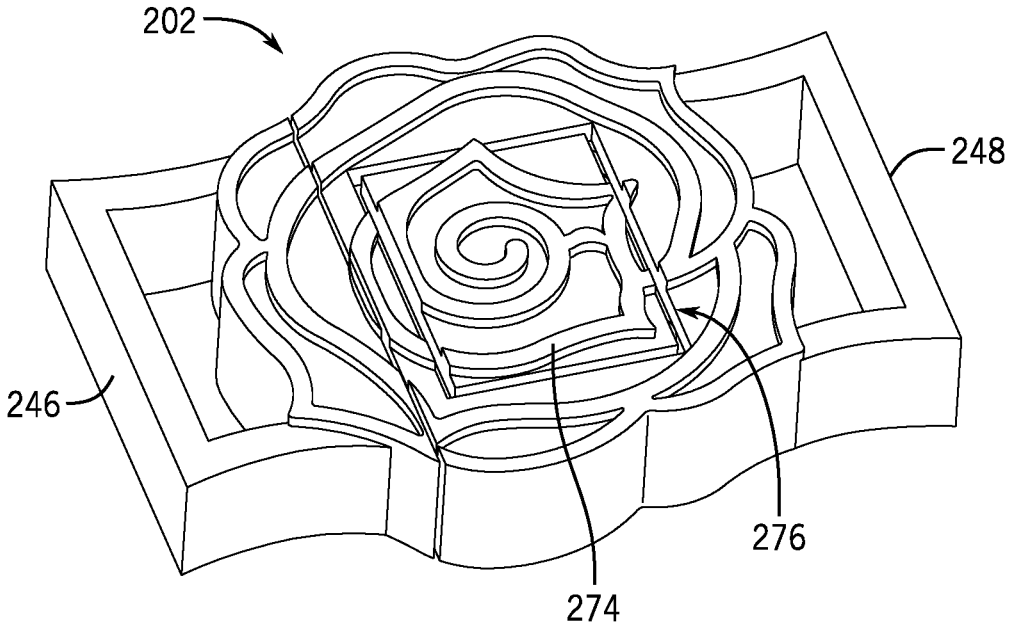
FIG. 5D is a front isometric view of the clasp assembly of FIG. 5A in the closed configuration.

In the illustrated embodiment, the first clasp member 246 can include a first lock body or lock member 274 and the second clasp member 248 can include a corresponding second lock body or lock member, such as an opening 276, for example. The lock member 274 of the first clasp member 246 may be pressed inward or otherwise disengaged from an opening 276 of the second clasp member 248 without requiring the user to bend, twist, or rotate any part of the closure system 202 or the first and second panels 206 of the bra 200. For example, a force exerted in a single first direction on the lock member 274 can be used to release the closure system 202 and then little or no force may be used to separate the first and second clasp members 246, 248 in a direction that is generally perpendicular to the first direction. In general, FIGS. 5A and 5B illustrate the first and second clasp members 246, 248 in an open, unsecured configuration and FIGS. 5C and 5D illustrate the first and second clasp members 246, 248 in a closed, secured configuration.

In general, the first and second lock members can provide an engagement (e.g., a sliding engagement) between the first and second clasp members 246, 248. Thus, the first and second clasp members 246, 248 can be selectively coupled and decoupled from each other. As described above, the first and second clasp members 246, 248 can be coupled by being slid or otherwise pinched together in the medial direction.

Furthermore, in other embodiments, the closure system 202 can be released by pinching the first and second clasp member 246, 248 inward (e.g., medially) to disengage the lock member 274. Thus, the closure system 202 can be coupled and decoupled with the same or similar movement. Additionally, as described above, the closure system 202 can include magnets to facilitate securing and closing the bra 200. For example, the clasp members 246, 248 can include magnets therein that help align the clasp members 246, 248 to engage (e.g., slidingly engage) one another and move into a locked position so that the bra 200 is clasped, closed, and secured. In general, a magnetic closure can be used to reduce the amount of precision required to close the bra 200 by self-centering or aligning the clasp members 246, 248, which can be beneficial to those with limited dexterity or singular limbs.

Figure 6:
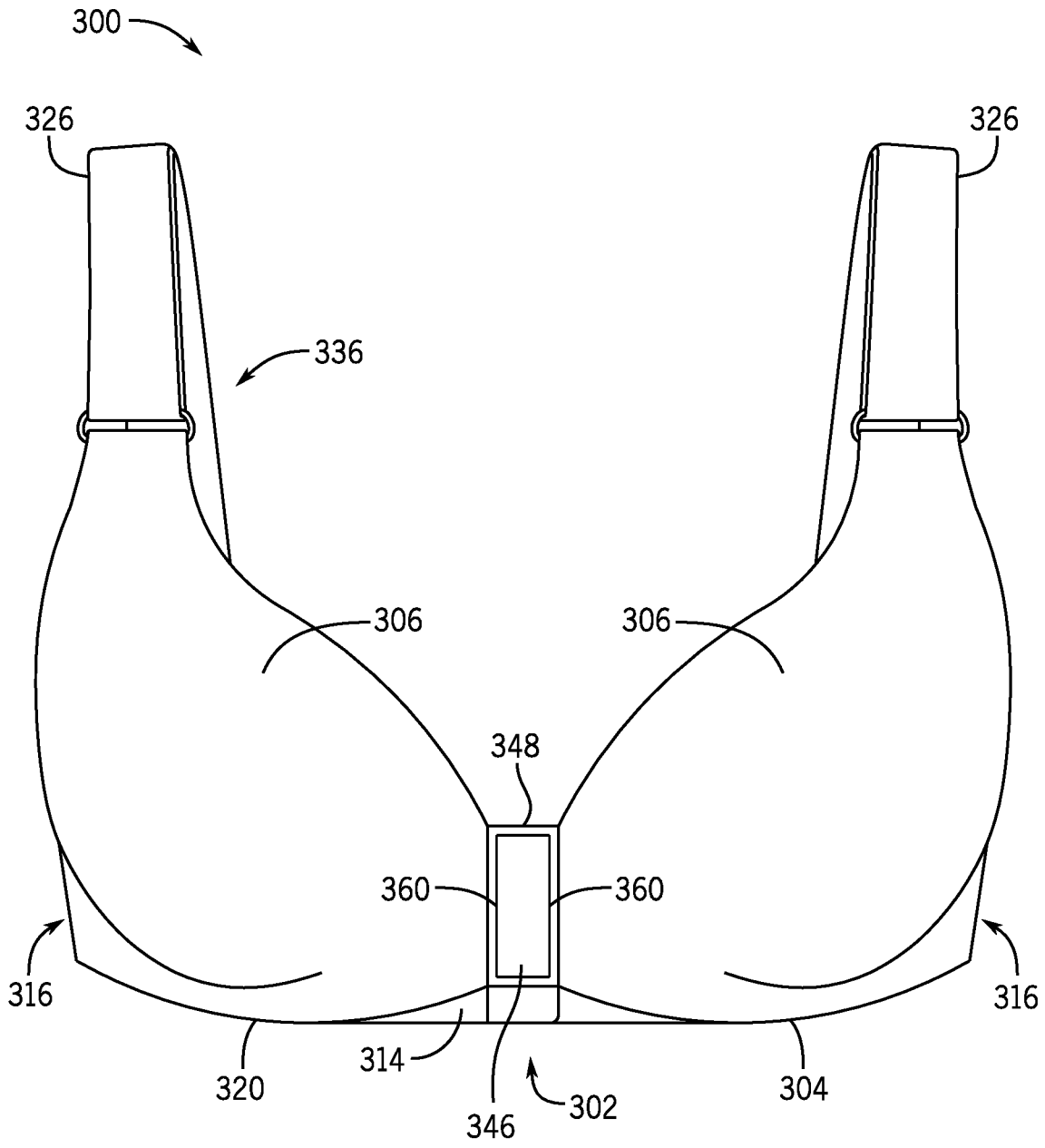
FIG. 6 is a front view of a bra that facilitates operation by someone with reduced dexterity according to another embodiment of the invention.

FIG. 6 illustrates another embodiment of a bra 300 having a closure system 302. The bra 300 includes similar components and features as the bras described herein, thus, descriptions of these components, identified with like reference numbers, can be found above with reference to the bras 100 and 200. Such similar components and features of the bra 300 include a front portion 304, first and second panels 306, a rear portion 314, first and second lateral side portions 316, a band 320, and first and second shoulder straps 326. The bra 300 can optionally include an adjustment system 336 at the shoulder straps 326 to adjust the length of the shoulder straps 326.

Figure 7A:
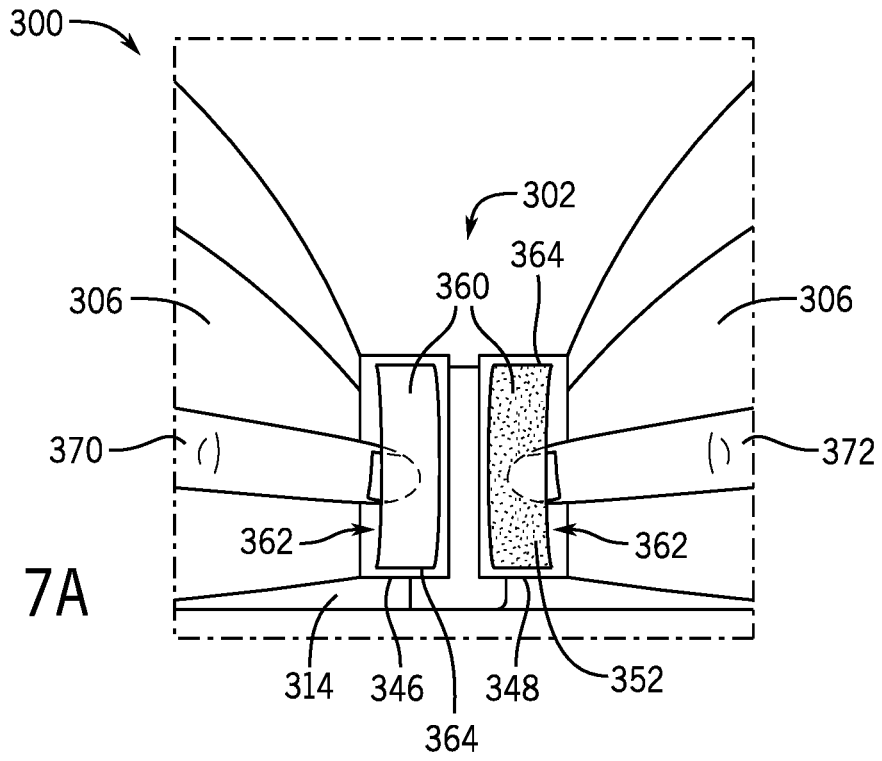
FIG. 7A is a detailed view of a closure system of the bra of FIG. 6 in an open configuration.
Figure 7B:
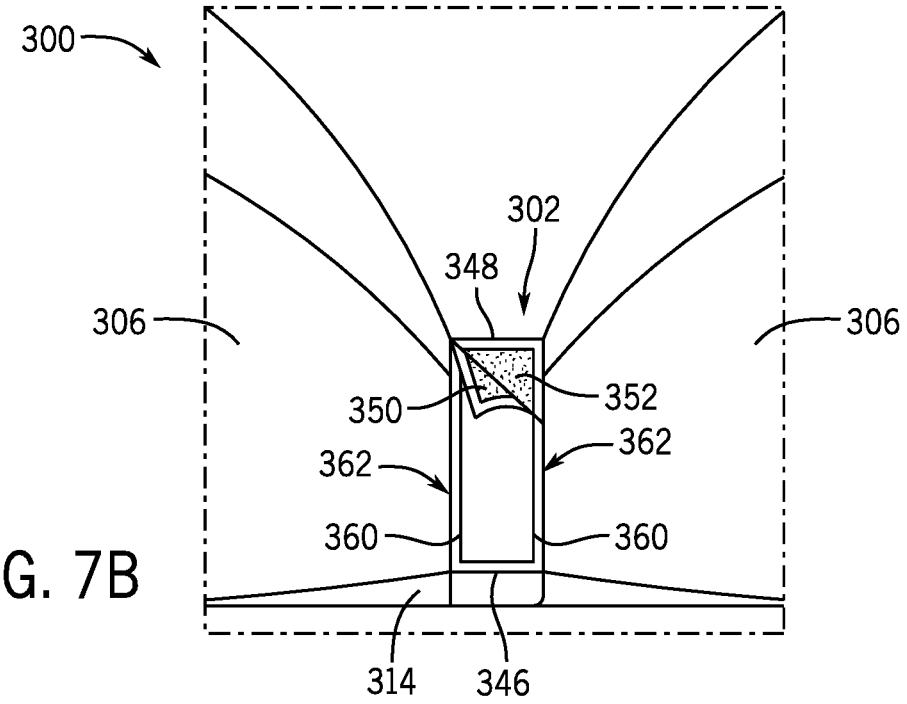
FIG. 7B is a detailed view of the closure system of FIG. 7A in a partially closed configuration.

As shown in FIGS. 6, 7A, and 7B, the closure system 302 of the bra 300 can include a first clasp member 346 and a second clasp member 348. The first and second clasp member 346, 348 can be configured as a variety of closure systems, including, for example, a hook and loop closure, a mechanical clasp having a sliding engagement or interference fit, and/or a magnet. Each clasp member 346, 348 can include an engagement portion that interacts with the corresponding engagement portion of the other clasp member. For example, as shown in FIG. 7B, the first clasp member 346 can include an engagement portion 350 that faces toward the wearer and the second clasp member 348 can include a corresponding engagement portion 352 that faces away from the wearer (e.g., when the bra 300 is in a closed configuration).

In one embodiment, the first engagement portion 350 can be configured as a loop material and the second engagement portion can be configured as a hook, material (or vice versa) of a hook and loop closure. As indicated in FIG. 7B, when the closure system 302 is in a closed position, a lower portion of the bra 300 (i.e., the band 320 or adjacent to the band 320) forms a complete circuit. In this regard, the bra 300 looks like a conventional rear-closure bra when in a closed position such that the first and second clasp member 346, 348 are not visible (e.g., in contrast to the closure system 202 described above).

Additionally, the closure system 302 can include a pair of finger engaging members 360 configured as finger pockets having one or more finger openings 362. The finger engaging members 360 can be disposed on the medial portions of the panels 306 adjacent to (e.g., on top of or under) the respective first and second clasp members 346, 348 and the band 320. As shown in FIG. 7B, in the illustrated embodiment, the finger engaging members 360 generally coincide with a respective one of the clasp members 346, 348. That is, when the closure system 302 is in a closed position, the finger engaging members 360 and the clasp members 346, 348 are stacked and are positioned at the same (or close) position along a medial/distal axis that extends along a transverse plane of the user. Likewise, when the closure system 302 is in a closed position, the finger engaging members 360 and the clasp members 346, 348 each are positioned along, or at least partially overlap a central vertical axis (e.g., like axis 108 shown in FIG. 1).

Furthermore, in the illustrated embodiment, the finger engaging members 360 define an outer periphery 364 (e.g., a closed, rectangular periphery, however, other geometries are possible including triangles or semi-circles). As shown, the outer periphery 364 defines a gap between the outer periphery 364 and the edge of the bra 300 at the general medial area of the panels 306. The outer periphery 364 can define the pocket formed by the finger engaging members 360. Furthermore, the outer periphery 364 can include multiple sides. For example, in the illustrated embodiment, the outer periphery 364 defines four sides. One of the sides of the outer periphery (e.g., a first side) can define the opening 362 and the remaining sides can be closed to form a pocket. In other embodiments (e.g., see FIG. 9), a finger engaging member, such as the finger engaging member 560 can still define an outer periphery and also include a plurality of openings.

In use, the user can insert a first finger 370 into the opening 362 at the first clasp member 346 and a insert a second finger 372 into the opening 362 at the second clasp member 348 to manipulate the medial portions of the panels 306 and move the first clasp member 346 toward the second clasp member 348. The closing motion for closing the bra 300 can include pointing the first finger 370 toward the second finger 372 and moving the fingers (e.g., hands) medially under (or across, or near) the user's breasts. The fingers 370, 372 can generally move in parallel so that the loop portion 350 (or other closure type) of the first clasp member 346 can engage the hook portion 352 (or other corresponding closure type) of the second clasp member 348 to secure the closure system 302 of the bra 300, as shown generally in FIG. 7B. In other exemplary closing motions, two fingers from a single hand (e.g., an index finger and thumb) can be used to close the closure system 302 by moving the fingers in a closing or pinching motion. Additionally, the finger openings 362 can be used to disengage the first and second clasp members 346, 348.

Figure 8:
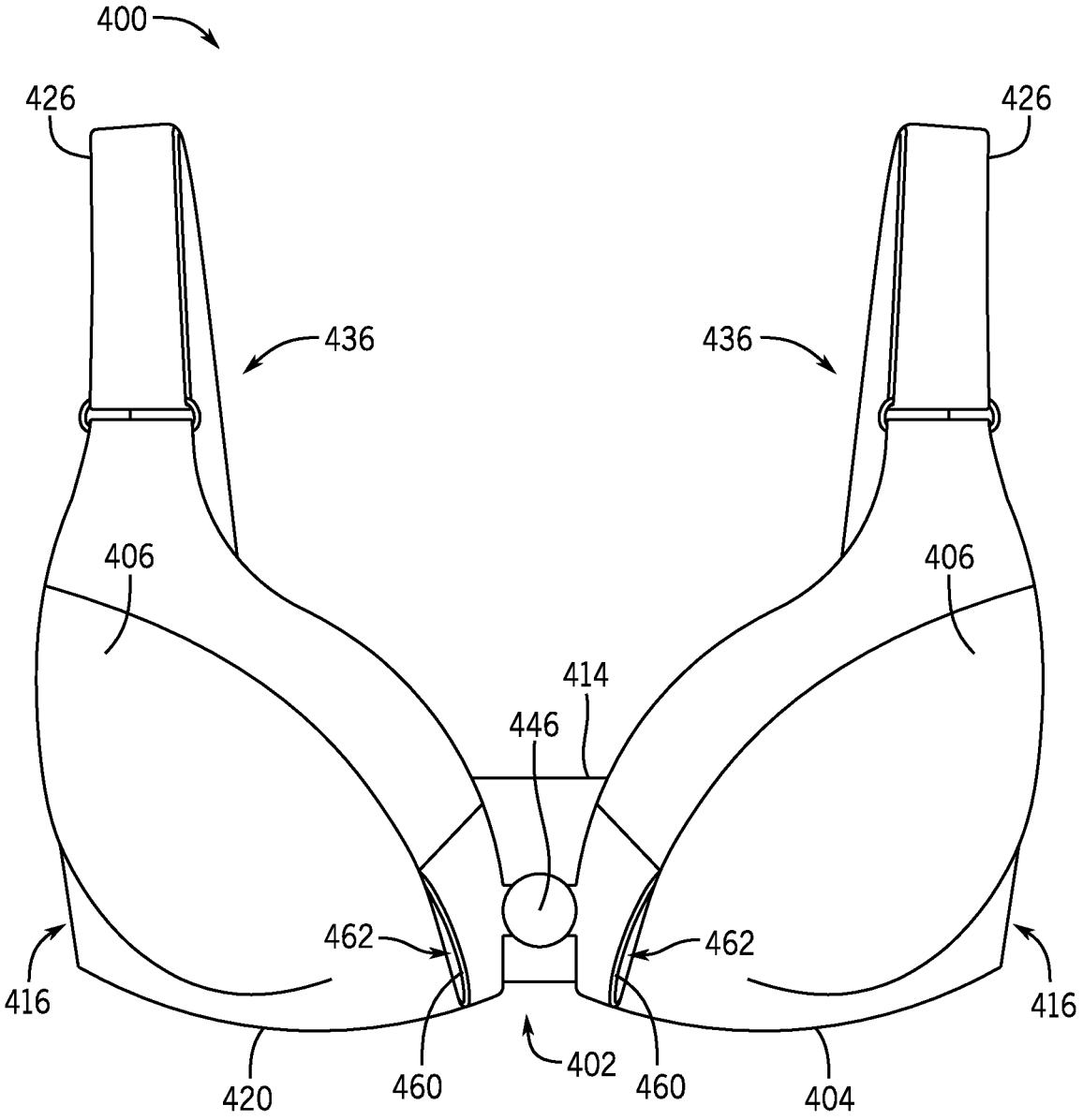
FIG. 8 is a front view of a bra that facilitates operation by someone with reduced dexterity according to another embodiment of the disclosure.

FIG. 8 illustrates another example embodiment of a bra 400 having a closure system 402. The bra 400 includes similar components and features as the bras described herein, thus, descriptions of these components, identified with like reference numbers, can be found above with reference to the bras 100 and 200. Such similar components and features of the bra 400 include a front portion 404, first and second panels 406, a rear portion 414, first and second lateral side portions 416, a band 420, and first and second shoulder straps 426. The bra 400 can optionally include an adjustment system 436 at the shoulder straps 426 to adjust the length of the shoulder straps 426.

The closure system 402 of the bra 400 can include first and second clasp members 446, which may include one or more of a hook and loop closure, a button closure, or other mechanically or magnetically engaging closures. Additionally, the closure system 402 can include a pair of finger engaging members 460 configured as finger pockets having one or more finger openings 462. The finger engaging members 460 can be disposed on the medial portions of the panels 406 adjacent to the respective first and second clasp members 446 and the band 420. In the illustrated embodiment, the finger engaging members 460 are positioned laterally from the clasp members 446. The finger openings 462 can be used similarly as described above with reference to the bras 200 and 300 to secure the first and second clasp members.

Figure 9:
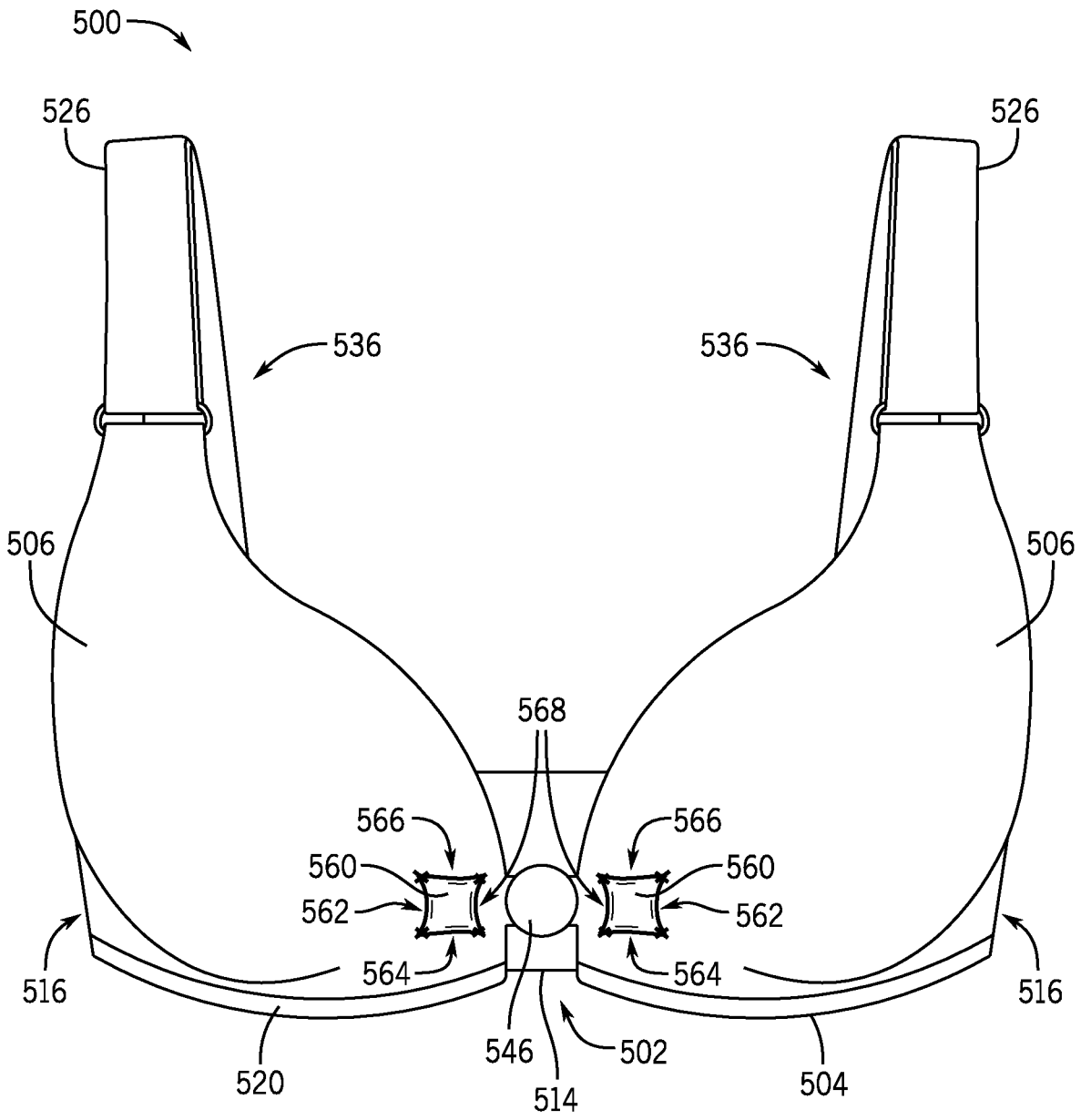
FIG. 9 is a front view of a bra that facilitates operation by someone with reduced dexterity according to another embodiment of the disclosure.

FIG. 9 illustrates another example embodiment of a bra 500 having a closure system 502. The bra 500 includes similar components and features as the bras described herein, thus, descriptions of these components, identified with like reference numbers, can be found above with reference to the bras 100 and 200. Such similar components and features of the bra 500 include a front portion 504, first and second panels 506, a rear portion 514, first and second lateral side portions 516, a band 520, and first and second shoulder straps 526. The bra 500 can optionally include an adjustment system 536 at the shoulder straps 526 to adjust the length of the shoulder straps 526. In some embodiments, the adjustment system 536 can include a finger loop that can allow a user to insert a digit therethrough to adjust the length of each shoulder strap 526.

The closure system 502 of the bra 500 can include first and second clasp members 546, which may include one or more of a hook and loop closure, a button closure, or other mechanically or magnetically engaging closures. Additionally, the closure system 502 can include a pair of finger engaging members 560 configured as finger pockets having one or more finger openings 562, 564, 566, 568. The finger engaging members 560 can be disposed on the medial portions of the panels 506 adjacent to the respective first and second clasp members 546 and the band 520. The finger openings 562, 564, 566, 568 can be used similarly as described above with reference to the bra 200 to secure the first and second clasp members. Additionally, the finger openings 568 can be used to disengage the first and second clasp members 546. In some embodiments, a variety of combinations of the finger openings can be used to disengage the clasp member 546, by, for example, moving (e.g., pinching) the finger engaging members 560 medially. Thus, the disengaging motion may be the same direction as the engaging motion so that, advantageously, the same (or similar) motion can be used to open and close the bra 500.

Figure 10:
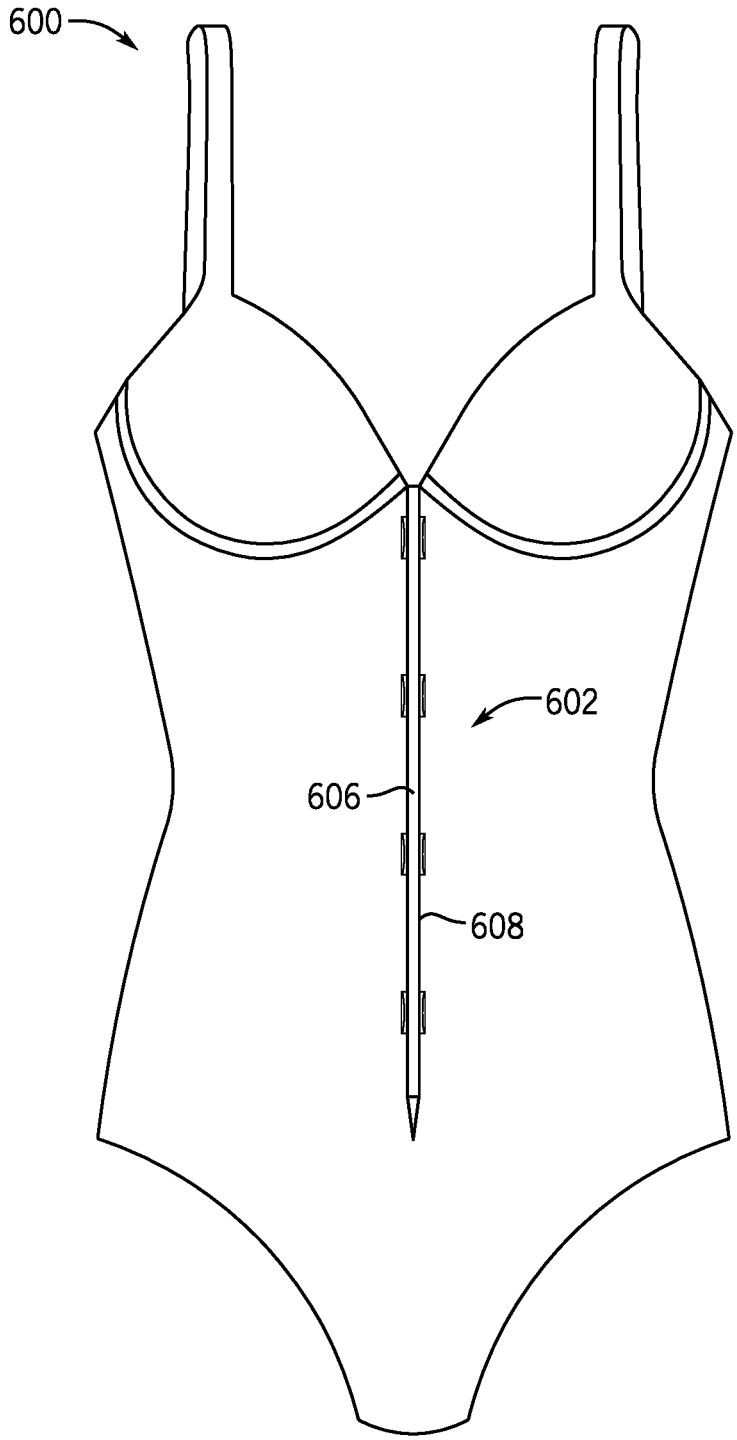
FIG. 10 is a front view of an undergarment that facilitates operation by someone with reduced dexterity according to another embodiment of the disclosure.
Figure 11:
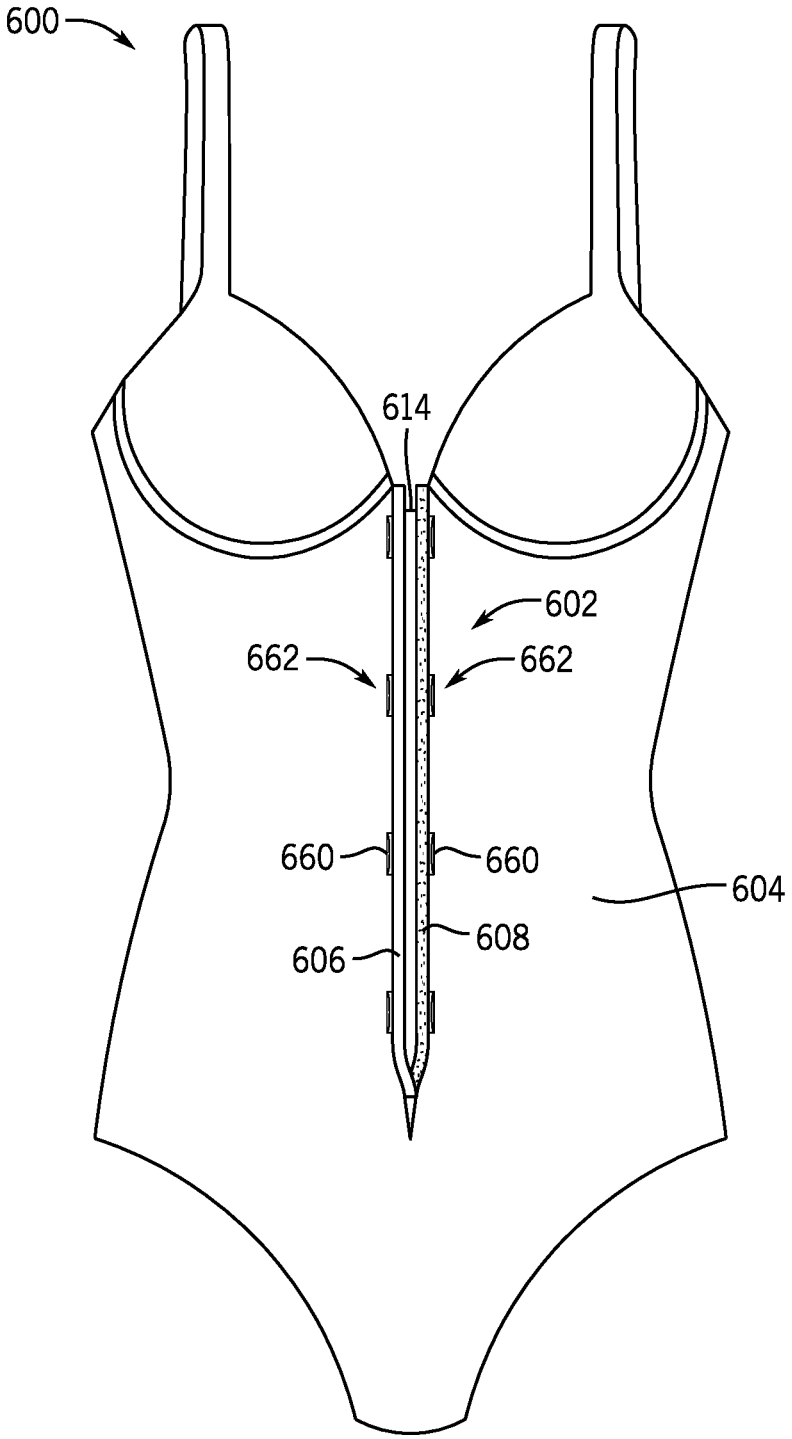
FIG. 11 is a front view of the undergarment of FIG. 10 in an open configuration.

FIGS. 10 and 11 illustrate another example embodiment of a garment 600. In some embodiments, the garment 600 may be worn as, for example, swimwear, lingerie, or a leotard. The garment 600 can include similar components and features as the bras described herein. In particular, the garment 600 can include a closure system 602 configured to secure a first portion 606 to a second portion 608 of the garment 600. Notably, the closure system 602 can include a finger engaging member 660 having one or more finger openings 662. The finger engaging members 660 can be disposed on medial portions of the first and second portions 606, 608. The finger openings 662 can be used similarly as described above to secure the first and second portions 606, 608 in a closed configuration. In the illustrated example, the closure system 602 is disposed on a front portion 604 of the garment 600. However, in other embodiments, the closures system 602 can be disposed on a rear portion 614 of the garment 600.

In other garments, such as, for example, underwear, tights, leggings, or other clothing having waistbands or general closures, finger engaging members configured as pockets can be used to facilitate closure with limited dexterity or other limb restrictions (e.g., a user having only one (usable) arm or hand). The finger pockets can provide a grip portion so that only two fingers or a single hand are required to close the garment. Similar to the embodiments described above, closures according to embodiments of the present disclosure can be operated with minimal dexterity requirements, such as, for example, a simple pinching motion.

The present disclosure is directed to an article of clothing, and/or specific components and closure systems for an article of clothing, such as a bra and other garments and their respective closure systems. The bra or other garments may comprise one or more fabric materials, such as, for example, nylon, polyester, cotton, Spandex (e.g., elastane), silk, elastic, lyocell fibers, modal fibers, or other materials and/or fibers generally made by knitting, weaving, or forming. The closure systems described herein may comprise a variety of materials including, for example, metals and polymers (e.g., plastic), which can have varying properties (e.g., flexible, magnet, rigid, pliable, etc.) or varying visual characteristics.

Any of the embodiments described herein may be modified to include any of the structures, elements, or methodologies disclosed in connection with different embodiments. In this regard, for example, the clasps 246, 248 of FIG. 2 (or others) may be incorporated into the closure system 302 of FIG. 6. Additionally, it should be appreciated that a clasp, as described herein, can include a variety of systems for fastening things together. For example, a clasp can include a device with interlocking parts (e.g., sliding engagement, snap, or interference fits), magnets, hook and loop, and combinations thereof. Further, the present disclosure is not limited to bras of the type specifically shown. Still further, aspects of the bra and methods of using the bra according to any of the embodiments disclosed herein may be modified to work with any type of article of clothing or supportive or form-fitting undergarment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

The systems of a methods of a bra and closure system as described herein advantageously provide an undergarment, and more specifically, a supportive undergarment, having enhanced adjustment and securement capabilities that can be utilized by an end user having limited dexterity.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

The invention claimed is:

1. An undergarment configured to facilitate operation by a wearer with limited dexterity, the undergarment comprising:

a front portion having a first panel and a second panel, the first panel being configured to at least partially surround a first breast and arranged on a first side of a vertical axis, the second panel being configured to at least partially surround a second breast and arranged on a second side of the vertical axis;

a rear portion;

a first lateral side portion connecting the first panel of the front portion and the rear portion;

a second lateral side portion connecting the second panel of the front portion and the rear portion;

a band configured to extend circumferentially around a rib cage of the wearer, the band disposed along a bottom of each of the first and second panels at the front portion; and a closure system configured to connect the band to form a closed loop in a closed configuration, the closure system including:

a first clasp member provided in line with the band along the bottom of the first panel and defining a first lock body;

a second clasp member provided in line with the band along the bottom of the second panel and defining a second lock body that corresponds to the first lock body;

a first finger engaging member arranged laterally outward from or on top of the first clasp member and having an opening dimensioned to receive a first finger; and a second finger engaging member arranged laterally outward from or on top of the second clasp member and having an opening dimensioned to receive a second finger, wherein, in the closed configuration, the first finger engaging member overlaps with the first clasp member and the second clasp member along a horizontal axis that extends between a left side of the front portion and a right side of the front portion.

2. The undergarment of claim 1, wherein the first clasp member extends toward the vertical axis from a right portion of the first panel and the second clasp member extends toward the vertical axis from a left portion of the second panel, and wherein each of the first and second finger engaging members are formed along the band.

3. The undergarment of claim 1, wherein, in the closed configuration, the first clasp member is positioned on top of the second clasp member.

4. The undergarment of claim 1, wherein the first clasp member is configured to slidably engage the second clasp member.

5. The undergarment of claim 4, wherein the closure system includes a magnet configured to facilitate alignment of the first and second clasp members prior to engagement.

6. The undergarment of claim 1, wherein an engagement portion of the first clasp member is configured to face toward the wearer and an engagement portion of the second clasp member is configured to face away from the wearer.

7. The undergarment of claim 1, wherein the opening of the first finger engaging member and the opening of the second finger engaging member are each defined by a respective outer periphery having first, second, and third sides, and wherein the first side defines the opening in the respective finger engaging member and the second and third sides are closed.

8. The undergarment of claim 7, wherein the respective outer periphery further includes a fourth side that is closed.

9. The undergarment of claim 1, wherein each of the first and second finger engaging members further comprises at least one additional opening, such that each of the first and second finger engaging members have a plurality of openings.

10. The undergarment of claim 1, wherein the undergarment further comprises:

first and second shoulder straps, each of the shoulder straps defining a strap body and a distal end, the distal end extending toward the rear portion of the undergarment and configured to be pulled away from the strap body to lengthen or tighten the respective shoulder strap, wherein the first shoulder strap connects the first panel to the rear portion and the second shoulder strap connects the second panel to the rear portion.

11. The undergarment of claim 1, wherein the front portion, the rear portion, and the first and second lateral side portions comprise fabric selected from the group consisting of cotton, nylon, polyester, elastane, and silk, and wherein the first and second clasp members comprise plastic or metal.

12. The undergarment of claim 1, wherein the undergarment is a form-fitting undergarment configured as a brassiere, a swimwear, a lingerie, or a leotard.

13. The undergarment of claim 1, wherein the first clasp member and the second clasp member each include a magnet.

14. The undergarment of claim 1, wherein the first clasp member is configured to magnetically engage the second clasp member.

15. The undergarment of claim 1, wherein the first finger engaging member and the second finger engaging member are each at least partially defined by the band.

16. The undergarment of claim 1, wherein the first finger engaging member and the second finger engaging member are attached to the band.

17. The undergarment of claim 1, wherein the first clasp member and the second clasp member each include an interlocking part that is configured to provide a snap fit.

* * * * *